US006202613B1

(12) United States Patent
Nagai

(10) Patent No.: US 6,202,613 B1
(45) Date of Patent: Mar. 20, 2001

(54) FOUR-STROKE CYCLE INTERNAL COMBUSTION ENGINE

(75) Inventor: Noboru Nagai, Hachioji (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 09/383,321

(22) Filed: Aug. 26, 1999

(30) Foreign Application Priority Data

Sep. 1, 1998 (JP) ..... 10-247447

(51) Int. Cl.[7] ..... F01M 1/06
(52) U.S. Cl. ..... 123/90.34
(58) Field of Search ..... 123/90.34, 90.33, 123/196 R, 196 M, 196 P, 196 W

(56) References Cited

U.S. PATENT DOCUMENTS 5,687,686 * 11/1997 Takahashi ..... 123/195 R
6,039,020 * 3/2000 Kawamoto et al. ..... 123/196 R

* cited by examiner

*Primary Examiner*—Teresa Walberg
*Assistant Examiner*—Vinod D Patel
(74) *Attorney, Agent, or Firm*—Jacobson, Price, Holman & Stern, PLLC

(57) ABSTRACT

A four-stroke cycle internal combustion engine is adapted to deliver oil mist from an oil reservoir to a cam chamber together with blow-by gas. It has an oil reservoir, a cam chamber, an oil dipper formed on a connecting rod for agitating oil in the oil reservoir to generate oil mist, a carburetor, and an oil separator provided between the cam chamber and the carburetor and for separating oil contained in oil mist from blow-by gas. The oil separator has a vertically extending first passage which communicates with the cam chamber at an upper end and communicates with the oil reservoir at a lower end and a second passage which communicates with the lower end of the first passage at one end and communicates with a venturi of the carburetor at the other end.

11 Claims, 5 Drawing Sheets

FOUR-STROKE CYCLE INTERNAL COMBUSTION ENGINE

BACKGROUND OF THE INVENTION

The present invention relates to a four-stroke cycle internal combustion engine preferably used for portable working machines such as a portable trimmer, though not restricted thereto, and in particular, to a four-stroke cycle internal combustion engine equipped with an oil separator for separating lubrication oil from blow-by gas.

DESCRIPTION OF THE PRIOR ART

From the viewpoint of solving a recent problem of air pollution problem caused by exhaust gas, there has been a demand for employing a four-stroke cycle internal combustion engine even for a portable trimmer to which a two-stroke cycle internal combustion engine has generally been employed. An example of this type of four-stroke cycle internal combustion engine is disclosed, for example, in Japanese Patent Laid-open Disclosure No. 8-260926 and such engine has an oil reservoir (oil pan) for accommodating oil for lubricating portions of the engine, which is provided below the crankcase. The oil in the oil reservoir is agitated by an oil dipper formed on a big end of a connecting rod to generate oil-mist. The oil-mist is pushed out of the oil reservoir to a cam chamber by positive pressure caused by downward movement of a piston and lubricates various components in the cam chamber. When the piston moves downwardly, blow-by gas generated in the crankcase is also delivered together with the oil-mist to the cam chamber and then, the blow-by gas is separated from oil before being emitted from a breather pipe to the outside or to an air cleaner.

The reason why the oil is separated in this manner is that firstly, the oil will be used up much earlier than a predetermined oil consumption period determined for each type of portable working machine and secondly, it will pollute the environment of the working place, if blow-by gas which is not completely separated from oil is emitted to the outside or to the air cleaner. Further when the blow-by gas containing oil is returned through the air cleaner to a combustion chamber, it will cause the combustion efficiency to go down and/or a filter element to be stained.

Therefore, the object of the present invention is to provide a four-stroke cycle internal combustion engine equipped with an oil separator for separating oil from blow-by gas which is highly reliable in an operation.

SUMMARY OF THE INVENTION

The above-mentioned object can be achieved by a four-stroke cycle internal combustion engine comprising: an oil reservoir; a cam chamber; an oil dipper formed on a connecting rod and for agitating oil in the oil reservoir to generate oil mist; a carburetor; and an oil separator being provided between the cam chamber and the carburetor and for separating oil contained in oil mist from blow-by gas; the oil separator having a first passage with an upper end and a lower end and a second passage with a first end and a second end, the first passage communicating with the cam chamber at the upper end and communicating with the oil reservoir at the lower end and the second passage communicating with the lower end of the first passage at the first end and communicating with a venturi of the carburetor at the second end; whereby the engine is adapted to deliver oil mist from the oil reservoir to the cam chamber together with blow-by gas.

The four-stroke cycle internal combustion engine of the present invention functions as follows.

When a piston of the four-stroke cycle internal combustion engine of the present invention moves upwardly and downwardly, the oil dipper formed on the connecting rod agitates lubrication oil accommodated in the oil reservoir. In this way, the oil mist is generated. When the piston moves upwardly, the blow-by gas is generated in the crankcase. Then, when the piston moves downwardly, the oil mist is delivered from the oil reservoir to the camshaft chamber together with the blow-by gas. This oil mist lubricates respective members in the cam chamber. Further, the mixture of excess oil mist and the blow-by gas flows downwardly through the first passage extending in a vertical direction toward the oil reservoir. During this process, the oil contained in the oil mist falls within the first passage by its own weight, adheres to and flows downwardly along the inner wall surface of the first passage, and is separated from the blow-by gas. The separated oil returns to the oil reservoir and is recycled. Further, the blow-by gas flows from the lower end of the first passage into the one end of the second passage, and is sucked from the other end into the venturi of the carburetor so as to be combusted again. The length of the first passage may be determined so that the oil contained in the oil mist can substantially be removed by falling by its own weight while the mixture passes through the first passage.

In a four-stroke cycle internal combustion engine of the present invention, the oil separator has a simple structure which enables to assure separation of the oil from the blow-by gas. Since the separated oil is returned to the oil reservoir, the oil can be recycled, preventing unnecessary consumption of oil. Further, since only blow-by gas is returned to a combustion chamber, it is possible to prevent reduction in the combustion efficiency.

DESCRIPTION OF THE PREFERRED EMBODIMENTS

Figure 1:
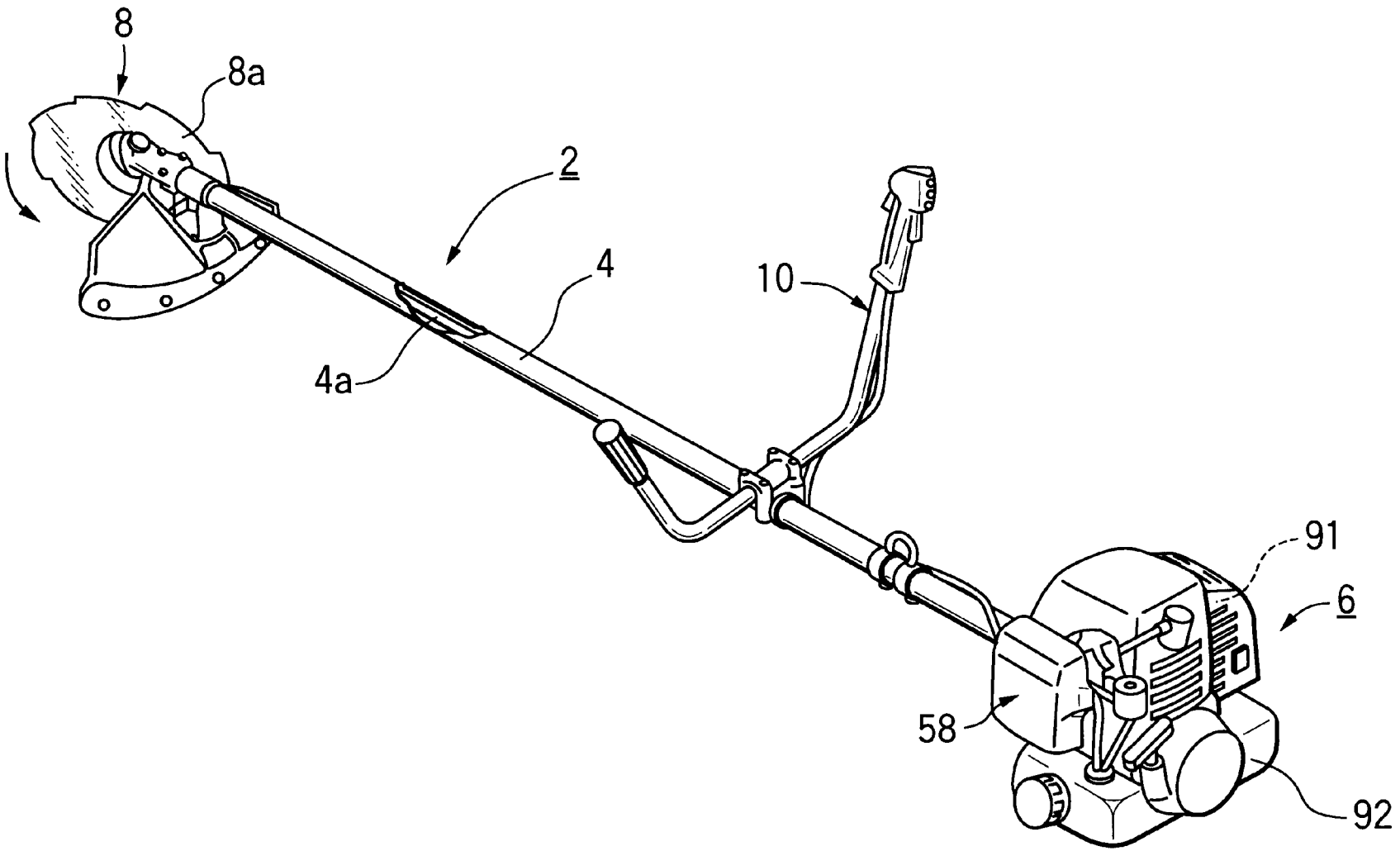
FIG. 1 is an overall perspective view of a portable trimmer.

Referring to the drawings attached herewith, embodiments of the present invention shall hereafter be described by explaining a portable trimmer as one example of portable working machines.

FIG. 1 is an overall perspective view of a portable trimmer.

As shown in FIG. 1, a portable trimmer includes a supporting tube 4 which has a power transmitting shaft 4*a* inserted therein, a four four-stroke cycle internal combustion engine 6 at its rear end, and a working section 8 at its front end. The working section 8 is equipped with a rotatable cutting blade 8*a* for cutting weeds in a direction indicated by an arrow. The rotational force from the four-stroke cycle internal combustion engine 6 is transmitted, via a centrifugal clutch or the like, to the power transmitting shaft 4*a* to rotate the cutting blade 8*a*. An operator holds a handle section 10, provided at the middle portion of the supporting tube 4, by both hands.

Figure 2:
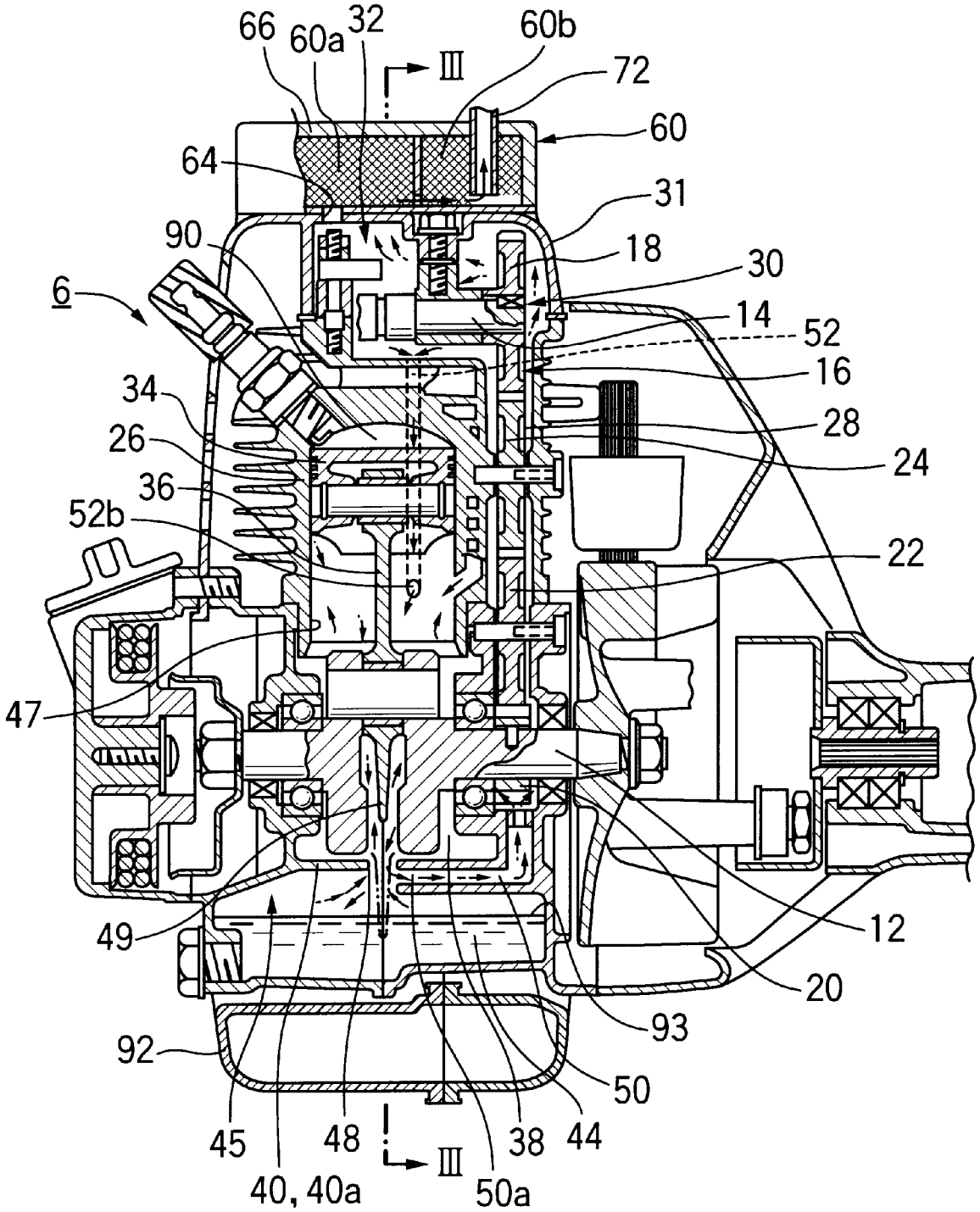
FIG. 2 is a cross-sectional view taken along a line II—II of FIG. 3, illustrating a four-stroke cycle internal combustion engine in accordance with an embodiment of the present invention.
Figure 3:
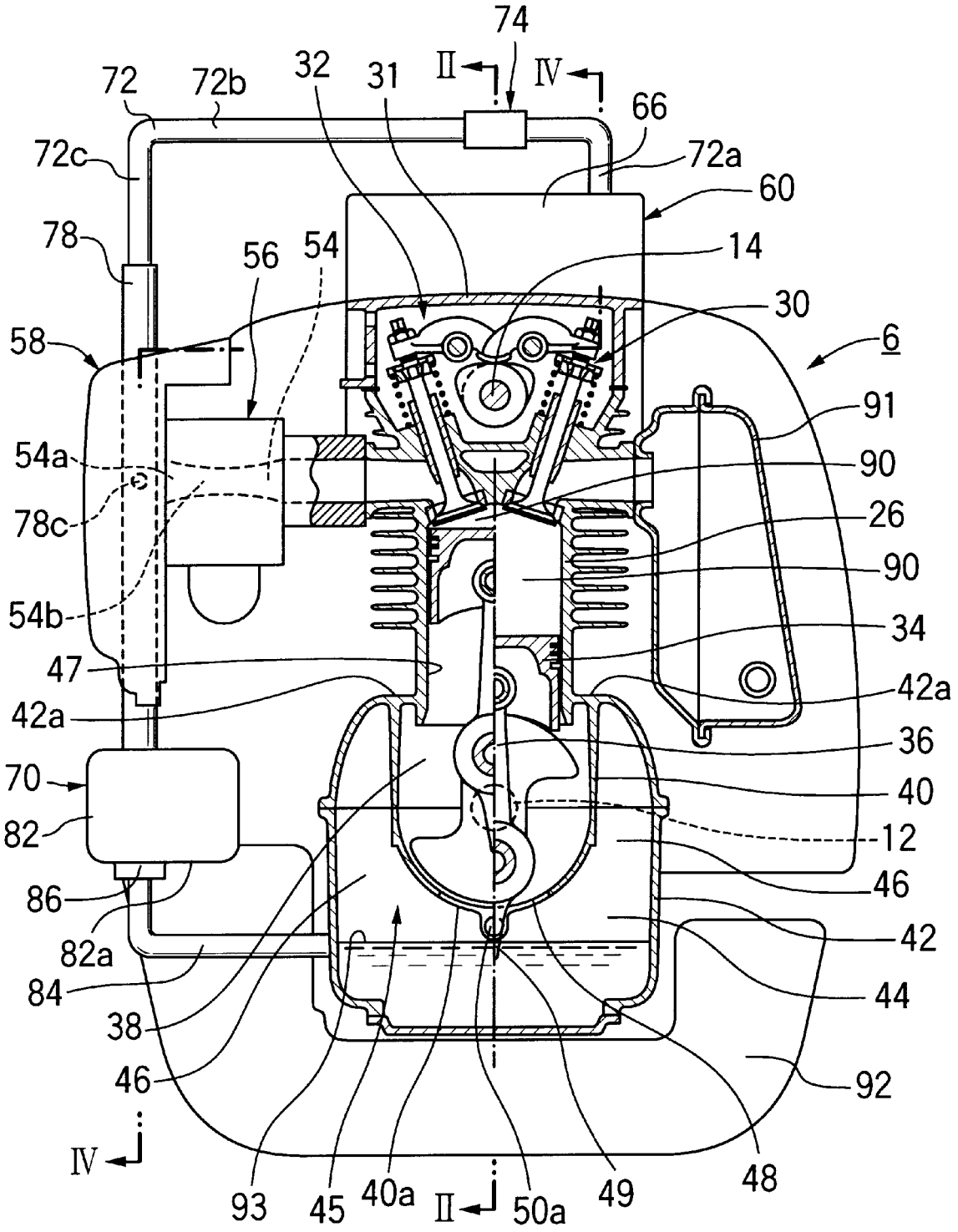
FIG. 3 is a cross-sectional view taken along a line III—III of FIG. 2 which is similar to FIG. 2.

FIGS. 2 and 3 are cross-sectional views of a four-stroke cycle internal combustion engine of the present embodiment, showing the views taken along a line II—II of FIG. 3 and a line III—III of FIG. 2 respectively.

The four-stroke cycle internal combustion engine 6 of the present embodiment shown in FIGS. 2 and 3, is of an air-cooled OHC type. As can be seen in FIG. 2, the rotation of a crankshaft 12 is transmitted to a camshaft 14 through a gear train 16 which includes a cam gear 18 attached to the camshaft 14, a crank gear 20 attached to the crankshaft 12, and two intermediate gears 22, 24 which are interposed between the crank gear 20 and the cam gear 18. The gear train 16 is disposed on the front side of a cylinder block 26 of the four-stroke cycle internal combustion engine 6, that is, the side toward the cutting blade 8*a*. The gear train 16 is disposed vertically along the cylinder block 26 and is accommodated in a gear chamber 28. The gear chamber 28 communicates with a cam chamber 32 to form a communicating space. The cam chamber 32 is defined by a liquid-tight detachable cover 31. A valve drive mechanism 30 which is mounted on an upper part of the cylinder block 26 is accommodated therein. The camshaft 14 is rotated by the gear train 16 which is synchronous with the movement of the crankshaft 12 and makes a half turn for each turn of the crankshaft 12, that is, for each up-and-down stroke of a piston 34.

As best shown in FIG. 3, the four-stroke cycle internal combustion engine 6, has an inner wall 40 surrounding a connecting rod 36 on both the left and right sides and the lower side thereof to form a crankcase 38. An outer wall 42 surrounds the inner wall 40 with upper ends 42*a* thereof connected to the inner wall 40 so as to form an oil reserving area 44 below the crankcase 38 and oil recess areas 46 on both sides of the crankcase 38. The oil reserving area 44 and the oil recess areas 46 together constitutes an oil reservoir 45. Further, as shown in FIG. 2, the connecting rod 36 has an oil dipper 49 extending vertically downward at its big end. On the other hand, a slit 48 is formed in the inner wall 40 so that the oil in the oil reservoir 45 can be agitated by the oil dipper 49 which enters and exits the oil reservoir 45 as the piston 34 moves upwardly and downwardly. While the oil is being agitated, oil mist is introduced from the oil reserving areas 44 into a cylinder bore 47 through the slit 48. The four-stroke cycle internal combustion engine 6 of the portable trimmer 2 according to the present embodiment is sometimes used in a tilted or upside-down position when an operator uses the cutting blade 8*a* to cut weeds located at a height more than the operator's waist or branches above the operator's head. In such a case, the oil stored in the oil reserving area 44 located below the crankcase 38 flows into the oil recess areas 46, 46 located on both sides of the crankcase 38 to prevent too much oil from flowing directly into the crankcase 38 through the slit 48.

As also can be seen in FIGS. 2 and 3, a horizontal inner wall channel 50 is formed horizontally along the lower surface of a bottom wall portion 40*a* of the inner wall 40. An inlet port 50*a* thereof communicates with the oil reserving area 44 and the other end thereof communicates with the gear chamber 28. Further, as previously described, the gear chamber 28 communicates with the cam chamber 32, and further communicates with the crankcase 38 through a cylinder block vertical channel 52 formed in the cylinder block 26 so that it opens toward the cam chamber 32 at one end (not shown) and opens toward the crankcase 38 at an outlet port 52*b* at the other end. That is, a communicating passage for oil mist extends between the oil reserving area 44 and the cylinder bore 47 via the horizontal inner wall channel 50, the gear chamber 28, the cam chamber 32, and the cylinder block vertical channel 52.

Further, as shown in FIG. 3, a carburetor 56 having a venturi 54 is provided on the suction side of the cylinder block 26, and on the outer side of the carburetor 56 an air cleaner 58 is provided.

Figure 4:
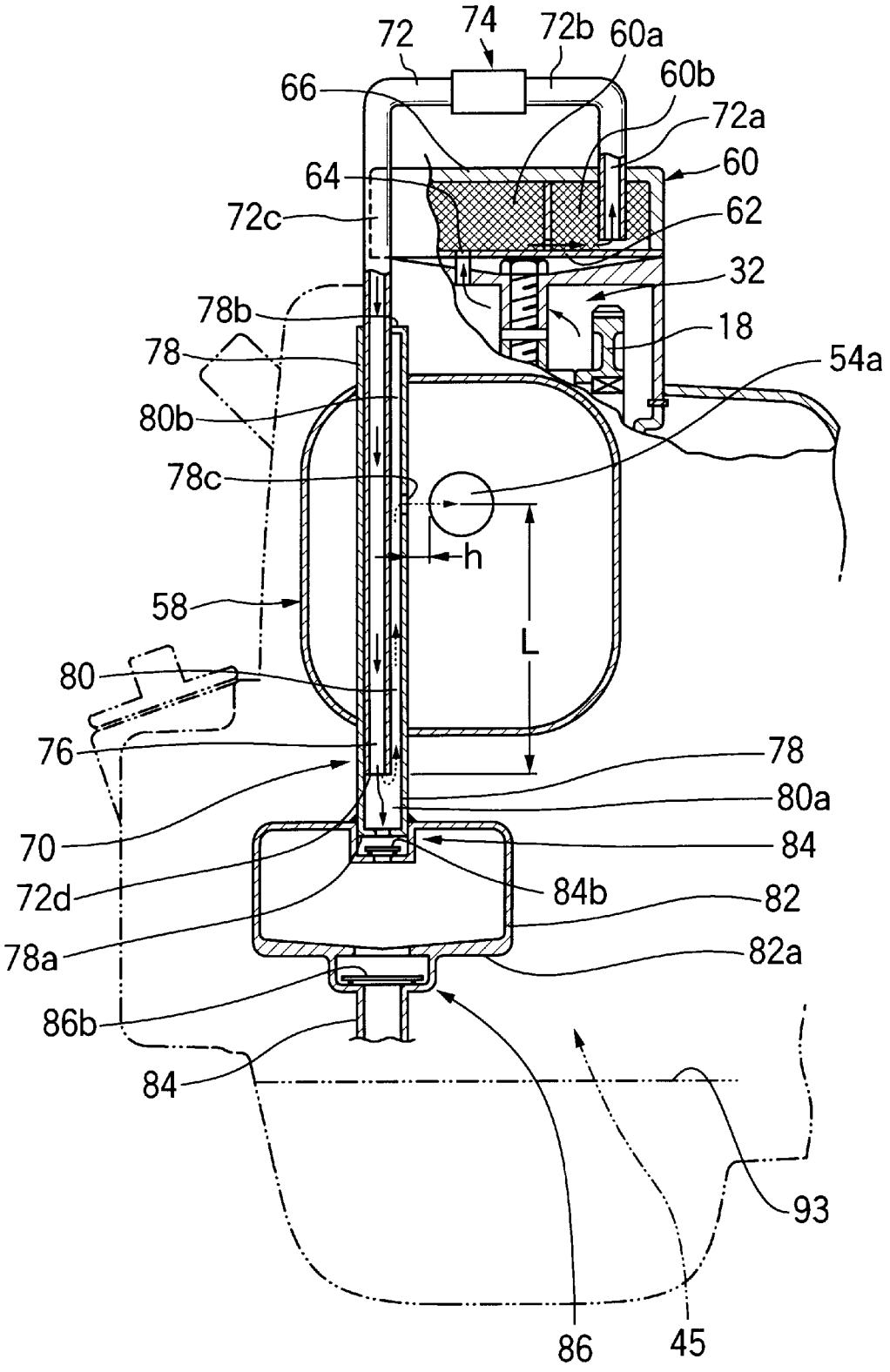
FIG. 4 is a detailed view taken along a line IV—IV of FIG. 3, illustrating an oil separation chamber and an oil separator.
Figure 5:
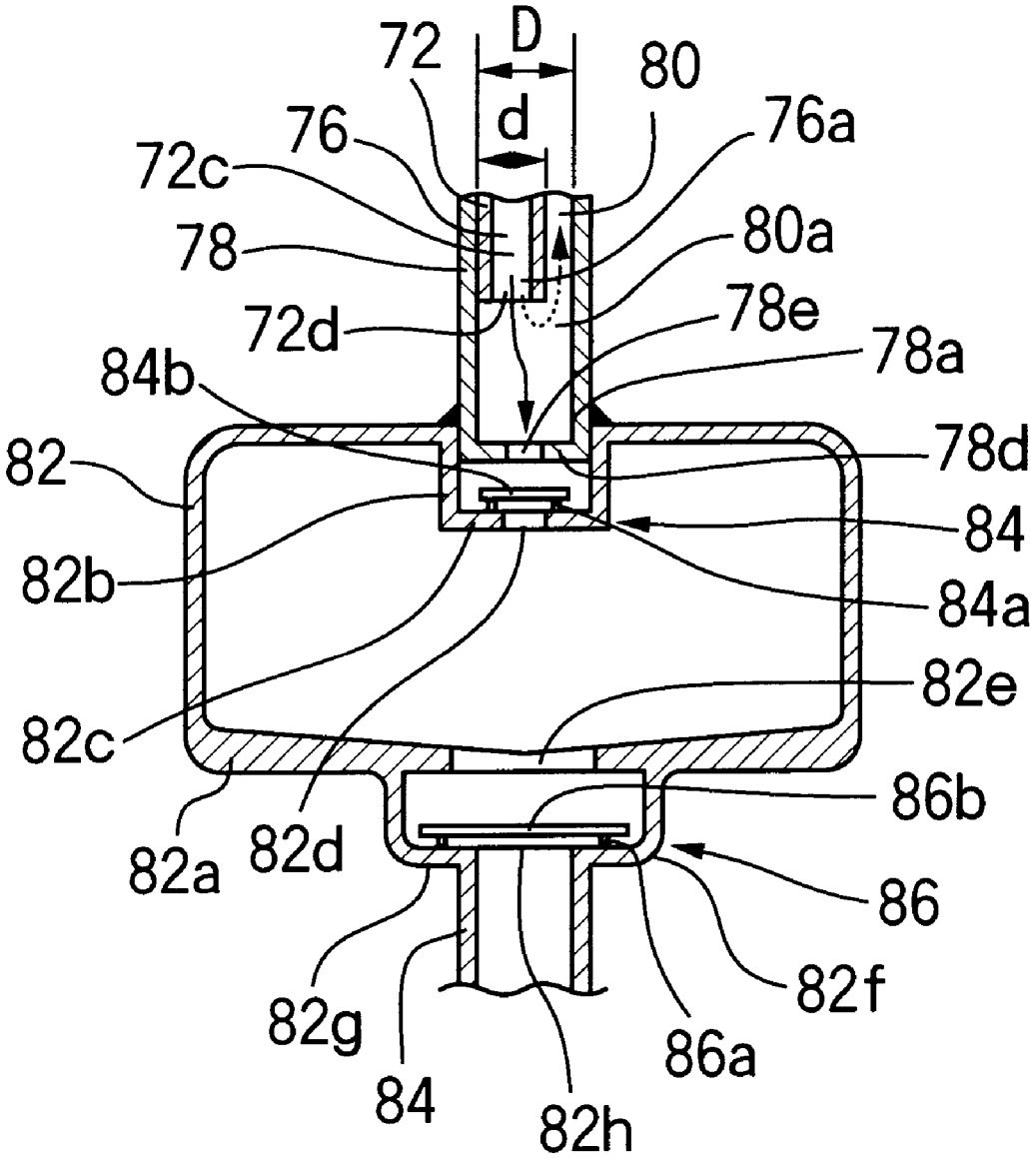
FIG. 5 is an enlarged sectional view of FIG. 4, illustrating an oil collecting tank of an oil separator.

FIG. 4 is a detailed view taken along a line IV—IV of FIG. 3, illustrating an oil separation chamber and an oil separator. Further, FIG. 5 is an enlarged sectional view of FIG. 4, illustrating a peripheral portion of an oil collecting tank of the oil separator.

As can be seen in FIGS. 2–4, the oil separation chamber 60 communicating with the cam chamber 32 is located above the cam chamber 32. Regarding the inner space of the oil separation chamber 60, the rear portion thereof on the side far away from the cutting blade 8*a*, that is, the left portion 60*a* viewed in FIGS. 2 and 4, accommodates steel-wool, and the front portion thereof on the side near the cutting blade 8*a*, that is, the right portion 60*b* viewed in FIGS. 2 and 4, accommodates a metal porous body or metal honeycomb. A partition wall 62 between the cam chamber 32 and the oil separation chamber 60 has a mixture inlet port 64 which is opened vertically at the rear portion of the steel-wool 60*a* and therebelow so that the cam chamber 32 and the oil separation chamber 60 communicate with each other. Further, a small pipe 72 which is connected to the front portion of the metal porous body 60*b* and will later be detailed, is connected to an upper wall 66 of the oil separation chamber 60. In this way, a channel is formed between the cam chamber 32 and the small pipe 72 via the steel-wool 60*a* and the metal porous body 60*b*.

Further, an oil separator 70 for separating oil from blow-by gas is provided between the oil separation chamber 60 and the oil reservoir 45. The oil separator 70 has the small pipe 72 generally formed in a substantially inverted letter "L". The small pipe 72 has a rising portion 72*a* extending vertically upward whose lower end is connected to the upper wall 66 of the oil separation chamber 60, a horizontal portion 72*b* connected to the rising portion 72*a*, and a vertical portion 72*c*, namely, a first pipe, extending straight in a vertical direction and which is connected to the horizontal portion 72*b* and whose lower end opens downward. The inner space of the vertical portion 72*c* forms a first passage 76. The horizontal portion 72*b* is provided with a third check valve 74 for preventing the counter flow of the oil to the oil separation chamber 60. While the mixture of excess oil mist and blow-by gas which has passed the cam chamber 32 passes through the vertical portion 72*c*, the oil falls by its own weight and also adheres to the inner wall of the vertical portion 72*c*, and whereby the oil is removed from the blow-by gas. Accordingly, the length of the vertical portion 72*c* or the first passage 76 is properly determined so that the oil can be sufficiently removed from the mixture while it passes therethrough.

Further the oil separator 70 has a large pipe 78, namely a second pipe, extending straight in a vertical direction and surrounding a lower portion of the vertical portion 72*c* of the small pipe 72. As shown in FIG. 5, the inner diameter D of the large pipe 78 is larger than the outer diameter d of the small pipe 72. The small pipe 72 is located so as to be offset in such a manner to make contact with the inner wall surface of the large pipe 78 on the far side from the cutting blade 8*a*, that is, the rear side surface of the inner wall surface of the large pipe 78. In this way, a second passage 80 is formed on the side near to the venturi 54 by the space between the outer surface of the small pipe 72 and the inner surface of the large pipe 78. The lower end 72*d* of the small pipe 72 is at a position higher than the lower end 78*a* of the large pipe 78, and thus the lower end 76*a* of the first passage 76 and the lower end 80*a* of the second passage 80 communicate with each other. The gap between the upper end 78*b* of the large pipe 78 and the outer surface of the small pipe 72 is sealed air tight. Further, as shown in FIGS. 3 and 4, the large pipe 78 is provided on an upper portion thereof with a port 78*c* which is open in a horizontal direction and right to the central axis of an inlet opening 54*a* of the venturi 54 of the carburetor 56. The port 78*c* is located to be apart from the inlet opening 54*a* by a horizontal distance h.

Further, the oil separator 70 has an oil collecting tank 82 located below the large pipe 78 for temporally storing separated oil. The volume of the oil collecting tank 82 is large enough to store oil expected to be separated by the oil separator 70 during one trimming session, that is, from the start to the stop of the four-stroke cycle internal combustion engine 6. As shown in FIG. 4, a bottom wall 82*a* of the oil collecting tank 82 is located at a position higher than the level 93 of the oil accommodated in the oil reservoir 45.

The lower end 78*a* of the large pipe 78 is connected to the oil collecting tank 82 via a second check valve 84 for preventing the counter flow of the collected oil. As shown in detail in FIG. 5, the lower end 78*a* of the large pipe 78 is closed by a lower end wall 78*d*, and at the center thereof a large pipe under hole 78*e* extending vertically is formed. Further, the oil collecting tank 82 has at its upper wall a second recess portion 82*b* to fit the lower end 78*a* of the large pipe 78 so that a space is formed between the lower end wall 78*d* and second recess portion 82*b*. The second recess portion 82*b* has a vertically extending oil flow hole 82*d* in its bottom wall 82*c*. Four second protuberances 84*a* which are projecting in an upward direction are formed equally spaced around the oil flow hole 82*d*. A second poppet valve 84*b* is placed on the protuberances 84*a*. When the four-stroke cycle internal combustion engine 6 is used in a tilted or upside-down position, the second poppet valve 84*b* works in such a way that it moves upwardly, viewed in FIG. 5, closes the large pipe under hole 78*e* at the lower end 78*d* of the large pipe 78, and prevents the counter flow of oil in the oil collecting tank 82.

Further, the oil separator 70 has an oil return pipe 84 extending from the bottom wall 82*a* of the oil collecting tank 82 to the oil reservoir 45, and the oil return pipe 84 and the bottom wall 82*a* of the oil collecting tank 82 are connected via a first check valve 86 similarly constituted as the second check valve 84. In more detail, the bottom wall 82*a* of the oil collecting tank 82 has another oil flow hole 82*e* extending in a vertical direction. Further, a first recess portion 82*f* protrudes downwardly from the lower surface of the bottom wall 82*a* below the oil collecting tank 82 so as to surround the another oil flow hole 82*e* to form a space between the bottom wall 82*a* and itself. At the center of a bottom wall portion 82*g* of the first recess portion 82*f*, a circular hole 82*h* extending vertically is formed. On the upper surface of the bottom wall portion 82*g*, four first protuberances 86*a* are formed to be equally spaced around the circular hole 82*h* and to be protruding upwardly, and a first poppet valve 86*b* is placed upon the protuberances 86*a*. The first check valve 86 is provided to prevent the oil in the oil reservoir 45 from flowing back into the oil collecting tank 82 via the oil return pipe 84 when the four-stroke cycle internal combustion engine 6 is used in a tilted or upside-down position.

The numerals 91, 92 in the drawings indicate an exhaust muffler and a fuel tank, respectively.

How the four-stroke cycle internal combustion engine 6 works will now be explained with an emphasis on the flow of oil mist and blow-by gas.

To start a trimming session, the four-stroke cycle internal combustion engine 6 is operated. As described above, the first check valve 86 is provided to prevent the oil in the oil reservoir 45 from flowing back via the oil return pipe 84. That is, when the four-stroke cycle internal combustion engine 6 is used in a tilted or upside-down position, the first poppet valve 86*b* moves upwardly, as shown in FIG. 4, to prevent the counter flow of the oil in the oil reservoir 45. In some cases, however, even when the four-stroke cycle internal combustion engine 6 is used in an upright position, the operation of the four-stroke cycle internal combustion engine 6 will bring about a temperature rise and then a pressure rise in the crankcase 38, and the positive pressure transmitted through the oil return pipe 84 will push the first poppet valve 86*b* upwardly to close the circular hole 82*h* of the first check valve 86. In this case, oil removed in the first passage 76 is kept stored in the oil collecting tank 82 while the four-stroke cycle internal combustion engine 6 is operating.

When the piston 34 moves upwardly and downwardly, the oil dipper 49 formed on the connecting rod 36 enters and exits the oil reservoir 45 through the slit 48 formed on the inner wall 40 and agitates oil in the oil reservoir 45 to generate oil mist. The oil mist in the oil reservoir 45 is delivered, through the horizontal inner wall channel 50, the gear chamber 28, and the cam chamber 32, to the gear train 16 and the valve drive mechanism 30 by the pressure change in the crankcase 38 created by the up-and-down stroke of the piston 34 to lubricate them. Oil adhered to the gears 18, 20, 22, 24 is also delivered to the cam chamber 32 by the rotation of the gears in the gear train 16. When the piston 34 moves upwardly, blow-by gas is generated in the crankcase 38. This blow-by gas is also delivered by the pressure change in the crankcase 38 created by the up-and-down stroke of the piston 34 through the slit 48 into the oil reservoir 45 and is further delivered as a mixture together with oil mist to the cam chamber 32.

In the cam chamber 32, the excess oil flows back from the cam chamber 32 through the cylinder block vertical channel 52 to the crankcase 38 and returns to the oil reservoir 45 through the slit 48. On the other hand, in the cam chamber 32, the gaseous oil mist and the blow-by gas flow into the oil separation chamber 60 through the mixture inlet port 64, and further flow out toward the small pipe 72 through the steel-wool 60*a* and the metal porous body 60*b*. When oil passes through the steel-wool 60*a* and the metal porous body 60*b*, some oil adheres thereto to be removed. The removed oil flows downwardly by its own weight into the cam chamber 32 through the mixture inlet port 64 and further flows from the cam chamber 32 to the crankcase 38 through the cylinder block vertical channel 52 and returns to the oil reservoir 45 through the slit 48.

The mixture of excess oil and blow-by gas flows into the small pipe 72. When the mixture flows downwardly in the first passage 76 of the vertical portion 72*c* of the small pipe 72, oil contained in the mixture falls downwardly by its own weight and oil adhered to the inner wall of the small pipe 72 flows downwardly therealong to be removed. The removed oil flows into the oil collecting tank 82 through the large pipe under hole 78*e*, a gap between the second poppet valve 84*b* of the second check valve 84 and the second protuberances 84*d*, and further the oil flow hole 82*d*. As described above, the second check valve 84 is closed while the four-stroke cycle internal combustion engine 6 is operating. Accordingly, the oil having entered the oil collecting tank 82 is kept stored therein while the four-stroke cycle internal combustion engine 6 is operating.

The blow-by gas whose oil has been removed while passing through the vertical portion 72*c* of the small pipe 72, flows from the lower end 76*a* of the first passage 76, through the lower end 80*a* of the second passage 80, upwardly inside the second passage 80 formed between the outer surface of the small pipe 72 and the inner surface of the large pipe 78, and runs from the port 78*c* through the air cleaner 58 into the venturi 54, and returns to a combustion chamber 90. This stream of blow-by gas is created due to suction through the port 78*c* by a negative pressure inside the venturi 54.

In this case, when the suction by the negative pressure inside the venturi 54 is too large, oil mist is also sucked from the first passage 76 into the second passage 80 due to negative pressure before oil is removed. When it occurs, the blow-by gas which still contains oil is returned into the combustion chamber 90 through the port 78*c* and the venturi 54. Therefore, according to the type of a four-stroke cycle internal combustion engine used as a portable working machine, the negative pressure at the port 78*c* created by the venturi 54 can be controlled in two ways described hereinbelow. The first method can be implemented by adjusting the length of the small pipe 72 to be inserted into the large pipe 78. That is, the length L from the lower end 72*d* of the small pipe 72 to the port 78*c* formed on the large pipe 78 is adjusted (see FIG. 4). When this length L is made longer, the negative pressure acting on the lower end 72*d* is reduced and thereby sufficient oil can be removed while oil mist is passing through the first passage 76. On the other hand, when the negative pressure at the port 78*c* is too small, sufficient oil may be removed but the stream of blow-by gas in the second passage 80 becomes stagnant and the blow-by gas can not be smoothly returned to the combustion chamber 90. Therefore, in this case, the length L is shortened so as to make the inserted length shorter and thereby the negative pressure acting on the lower end 72*d* is increased.

In the second method, the negative pressure acting on the port 78*c* can be controlled by adjusting the distance h between the port 78*c* and the inlet opening 54*a* of the venturi 54. When the distance h is made shorter, the negative pressure is increased, and on the other hand, when the distance h is made longer, it is reduced. The reason why the port 78*c* is located in the vicinity of the inlet opening 54*a* of the venturi 54 is that the negative pressure on the side of the inlet opening 54*a* is not too large compared with that at a throat 54*b* of the venturi 54 and at the same time the acting negative pressure can easily be controlled by simply bringing close or keeping away the port 78*c* with respect to the inlet opening 54*a*.

When, for example, an operator trims a branch of a tree over his head using the portable trimmer 2, the four-stroke cycle internal combustion engine 6 is sometimes slanted to take a tilted or upside-down position. In this case, the second poppet valve 84*b* of the second check valve 84 moves upwardly, as shown in FIG. 5, by its own weight and thereby closes the large pipe under opening 78*e*. In this way, the counter flow of oil stored in the oil collecting tank 82 can be prevented. Also in case the first poppet valve 86*b* of the first check valve 86 is not moved, for some reason, by the pressure increase in the crankcase 38 and the oil flow hole 82*e* is closed, the first poppet valve 86*b* similarly moves upwardly by its own weight, as shown in FIG. 4, to close the oil flow hole 82*e* and the counter flow of oil from the oil reservoir 45 is prevented. Similarly, the counter flow of oil into the oil separation chamber 60 is prevented by the third check valve 74 provided in the small pipe 72.

When the trimming session is over and the four-stroke cycle internal combustion engine 6 is stopped, the crankcase 38 is cooled and the internal pressure therein returns to the atmospheric pressure. Thus, the first poppet valve 86*b* falls down by its own weight and the oil flow hole 82*e* is opened. In this way, the oil stored in the oil collecting tank 82 while the four-stroke cycle internal combustion engine 6 has been operating, is returned by the pressure head difference from the oil flow hole 82*e*, through a gap between the first poppet valve 86*b* and the first protuberances 86*a*, and the oil return pipe 84, to the oil reservoir 45.

In the present embodiment, since the oil separator 70 has the first passage 76 formed by the vertical portion 72*c* of the small pipe 72, a simple mechanism utilizing the fall of oil by its own weight allows oil to be certainly removed from blow-by gas.

Further, in the present embodiment, since the first check valve 86, the second check valve 84, and the third check valve 74 are provided, the counter flow of oil can be prevented even when the four-stroke cycle internal combustion engine 6 is used in a tilted position.

Further, in the present embodiment, since the oil collecting tank 82 is provided below the lower end 72*d* of the first passage 76, even when the first check valve 86 is closed by the increase of internal pressure due to a temperature rise in the crankcase 38, oil is stored in the oil collecting tank 82 while the four-stroke cycle internal combustion engine 6 is operating and the first passage 76 is not closed by the removed oil.

Further, in the present embodiment, since the other end 80*b* of the second passage 80 is open toward the vicinity of the inlet opening 54*a* of the venturi 54, a proper negative pressure acts, compared with the case in which the other end 80*b* is opened toward the throat 54*b* of the venturi 54, and blow-by gas containing oil can be prevented from being sucked into the second passage 80. Further, the negative pressure can easily be controlled by simply changing the distance h between the port 78*c* and the inlet opening 54*a* of the venturi 54.

Further, in the present embodiment, since the first passage 76 and the second passage 80 are formed by inserting the small pipe 72 into the large pipe 78, the negative pressure can be controlled by changing the length of the small pipe 72 to be inserted into the large pipe 78, in response to the type of four-stroke cycle internal combustion engine, without the necessity of changing the structure of the oil separator 70.

Further, in the present embodiment, since the oil separation chamber 60 is provided, oil can certainly be separated from blow-by gas. Since the oil separation chamber 60 removes beforehand some oil upstream of the oil separator 70, sufficient oil can be removed even when the first passage 76 is made relatively shorter, and it is possible to design the oil separator 70 to be provided within a restricted space inside the housing of the four-stroke cycle internal combustion engine 6.

The present invention has thus been shown and described with reference to specific embodiments. However, it should be noted that the present invention is in no way limited to the details of the described arrangements but changes and modifications may be made without departing from the scope of the appended claims.

For example, since the four-stroke cycle internal combustion engine 6 for the portable trimmer 2 in the embodiments described above is used in a tilted or upside-down position, the first check valve 86, the second check valve 84, and the third check valve 74 are provided for preventing the counter flow of oil, but these check valves need not necessarily be provided when the four-stroke cycle internal combustion engine 6 is used in a substantially fixed position.

Further, similarly, when the four-stroke cycle internal combustion engine 6 is used only in an upright position, the first check valve 86 need not necessarily be provided, and in this case, the oil collecting tank 82 also need not necessarily be provided. That is, since the space between the first passage 76 and the oil return pipe 84 is not closed by the increase of internal pressure in the crankcase 38, oil removed in the first passage 76 may directly be returned to the oil reservoir 45 through the oil return pipe 84.

Further, the oil separator 70 is convenient for adjusting the distance L since it is formed by a double pipe comprising the small pipe 72 and the large pipe 78. This separator, however, need not necessarily be a double pipe, and therefore, for example, the inner space of one pipe may be partitioned along its longitudinal direction by a partition wall to form the first passage 76 and the second passage 80. Further, another example may be possible in which the oil separator 70 has the first pipe 72*c* forming the first passage 76 and the second pipe 78 forming the first passage 80 which are arranged in parallel, respective lower ends of the first pipe 72*c* and the second pipe 78 are separately connected to the oil collecting tank 82, and the first passage 76 and the second passage 80 are connected to communicate with each other through the inner space of the oil collecting tank 82.

Further, in the present embodiment, though the first passage 76 extends vertically, it may extend obliquely and is not restricted to "vertically" so long as it extends in a sense having an up-and-down direction, that is, one end higher or lower than the other end.

Further, in the present embodiment, though the second passage 80 also extends vertically, it may extend obliquely or horizontally and is not restricted to "vertically".

Further, in the present embodiment, though the port 78*c* is located in the vicinity of the inlet opening 54*a* of the venturi 54, the port 78*c* and the throat 54*b* of the venturi 54 may be connected to each other via a pipe and the like, when a higher negative pressure is necessary at the second passage 80.

Further, as seen in the present embodiment described above, to remove oil more certainly, the oil separation chamber 60 is preferably located upstream of the oil separator 70, but the oil separation chamber need not necessarily be provided.

What is claimed is:

1. A four-stroke cycle internal combustion engine comprising:

an oil reservoir;

a cam chamber;

an oil dipper formed on a connecting rod and for agitating oil in said oil reservoir to generate oil mist;

a carburetor; and an oil separator being provided between said cam chamber and said carburetor and for separating oil contained in oil mist from blow-by gas;

said oil separator having a first passage with an upper end and a lower end and a second passage with a first end and a second end, said first passage communicating with said cam chamber at said upper end and communicating with said oil reservoir at said lower end and said second passage communicating with said lower end of said first passage at said first end and communicating with a venturi of said carburetor at said second end;

whereby said engine is adapted to deliver oil mist from said oil reservoir to said cam chamber together with blow-by gas.

2. A four-stroke cycle internal combustion engine in accordance with claim 1, further comprising:

an oil collecting tank for collecting oil, said oil collecting tank being provided between said lower end of said first passage and said oil reservoir; and a first check valve for preventing the counter flow of oil from said oil reservoir, said first check valve being provided between said oil collecting tank and said oil reservoir.

3. A four-stroke cycle internal combustion engine in accordance with claim 2, further comprising a second check valve for preventing the counter flow of oil collected in said oil collecting tank, said second check valve being provided between said lower end of said first passage and said oil collecting tank.

4. A four-stroke cycle internal combustion engine in accordance with claim 3, in which:

said second end of said second passage is open toward the vicinity of an inlet opening of said venturi.

5. A four-stroke cycle internal combustion engine in accordance with claim 4, further comprising a first pipe and a second pipe both of which extend straight in a direction in which respective lower ends of said first and second pipes are lower than respective upper ends of said first and second pipes, wherein:

said first pipe is inserted within said second pipe;

said first passage is formed by an inner space of said first pipe;

said second passage is defined by a space between the outer surface of said first pipe and the inner surface of said second pipe;

said lower end of said first pipe terminates above said lower end of said second pipe;

said first passage and said second passage communicate with each other;

said upper end of said first pipe communicates with said cam chamber;

said lower end of said second pipe is connected to said oil collecting tank; and a port is formed on an upper portion of said second pipe to be open toward the inner space of said venturi.

6. A four-stroke cycle internal combustion engine in accordance with claim 3, further comprising a first pipe and a second pipe both of which extend straight in a direction in which respective lower ends of said first and second pipes are lower than respective upper ends of said first and second pipes, wherein:

said first pipe is inserted within said second pipe;

said first passage is formed by an inner space of said first pipe;

said second passage is defined by a space between the outer surface of said first pipe and the inner surface of said second pipe;

said lower end of said first pipe terminates above said lower end of said second pipe;

said first passage and said second passage communicate with each other;

said upper end of said first pipe communicates with said cam chamber;

said lower end of said second pipe is connected to said oil collecting tank; and a port is formed on an upper portion of said second pipe to be open toward the inner space of said venturi.

7. A four-stroke cycle internal combustion engine in accordance with claim 2, in which:

said second end of said second passage is open toward the vicinity of an inlet opening of said venturi.

8. A four-stroke cycle internal combustion engine in accordance with claim 7, further comprising a first pipe and a second pipe both of which extend straight in a direction in which respective lower ends of said first and second pipes are lower than respective upper ends of said first and second pipes, wherein:

said first pipe is inserted within said second pipe;

said first passage is formed by an inner space of said first pipe;

said second passage is defined by a space between the outer surface of said first pipe and the inner surface of said second pipe;

said lower end of said first pipe terminates above said lower end of said second pipe;

said first passage and said second passage communicate with each other;

said upper end of said first pipe communicates with said cam chamber;

said lower end of said second pipe is connected to said oil collecting tank; and a port is formed on an upper portion of said second pipe to be open toward the inner space of said venturi.

9. A four-stroke cycle internal combustion engine in accordance with claim 2, further comprising a first pipe and a second pipe both of which extend straight in a direction in which respective lower ends of said first and second pipes are lower than respective upper ends of said first and second pipes, wherein:

said first pipe is inserted within said second pipe;

said first passage is formed by an inner space of said first pipe;

said second passage is defined by a space between the outer surface of said first pipe and the inner surface of said second pipe;

said lower end of said first pipe terminates above said lower end of said second pipe;

said first passage and said second passage communicate with each other;

said upper end of said first pipe communicates with said cam chamber;

said lower end of said second pipe is connected to said oil collecting tank; and a port is formed on an upper portion of said second pipe to be open toward the inner space of said venturi.

10. A four-stroke cycle internal combustion engine in accordance with claim 1, in which:

said second end of said second passage is open toward the vicinity of an inlet opening of said venturi.

11. A four-stroke cycle internal combustion engine in accordance with claim 10, further comprising a first pipe and a second pipe both of which extend straight in a direction in which respective lower ends of said first and second pipes are lower than respective upper ends of said first and second pipes, wherein:

said first pipe is inserted within said second pipe;

said first passage is formed by an inner space of said first pipe;

said second passage is defined by a space between the outer surface of said first pipe and the inner surface of said second pipe;

said lower end of said first pipe terminates above said lower end of said second pipe;

said first passage and said second passage communicate with each other;

said upper end of said first pipe communicates with said cam chamber;

said lower end of said second pipe is connected to said oil collecting tank; and a port is formed on an upper portion of said second pipe to be open toward the inner space of said venturi.

* * * * *